United States Patent [19]

Kicherer et al.

[11] Patent Number: 4,901,049

[45] Date of Patent: Feb. 13, 1990

[54] TEMPERATURE LIMITER

[75] Inventors: Robert Kicherer, Oberderdingen; Willi Essig, Boeblingen; Heinz Petri, Bretten, all of Fed. Rep. of Germany

[73] Assignee: E.G.O. Elektro-Gerate Blanc u. Fischer, Fed. Rep. of Germany

[21] Appl. No.: 157,896

[22] Filed: Feb. 19, 1988

[30] Foreign Application Priority Data

Feb. 19, 1987 [DE] Fed. Rep. of Germany ..... 3705260

[51] Int. Cl.[4] ..... H01H 37/48

[52] U.S. Cl. ..... 337/394; 337/383; 219/449

[58] Field of Search ..... 337/394, 393, 382, 383, 337/388, 389, 390; 219/449, 464

[56] References Cited

U.S. PATENT DOCUMENTS

| | | | |
|---|---|---|---|
| 4,544,831 | 10/1985 | Bayer | 337/394 |
| 4,577,176 | 3/1986 | Bayer | 219/449 |
| 4,633,238 | 12/1986 | Goessler et al. | 219/449 |
| 4,695,816 | 9/1987 | Essig et al. | 337/394 |

FOREIGN PATENT DOCUMENTS

| | | |
|---|---|---|
| 0116861 | 8/1984 | European Pat. Off. . |
| 756796 | 4/1952 | Fed. Rep. of Germany . |
| 1806651 | 6/1969 | Fed. Rep. of Germany . |
| 7813597 | 8/1978 | Fed. Rep. of Germany . |
| 2748109 | 5/1979 | Fed. Rep. of Germany . |
| 2839161 | 3/1980 | Fed. Rep. of Germany . |
| 3100758 | 9/1982 | Fed. Rep. of Germany . |
| 376540 | 1/1983 | Fed. Rep. of Germany . |
| 3423086 | 1/1985 | Fed. Rep. of Germany . |
| 3333645 | 4/1985 | Fed. Rep. of Germany . |
| 3410442 | 9/1985 | Fed. Rep. of Germany . |
| 848518 | 9/1960 | United Kingdom . |

*Primary Examiner*—H. Broome

*Attorney, Agent, or Firm*—Steele, Gould & Fried

[57] ABSTRACT

In a temperature limiter (1) with a rod-like temperature sensor (6), the outer tube is formed by a continuously tensile-stressed insulating tube (7) extending into a base (2). An inner rod (8), optionally articulated two or more times in the longitudinal direction, is constructed as a continuously pressure-loaded rod, characterized by temperature-dependent length expansion. The temperature limiter (1), e.g., for a glass ceramic unit, may have a circuit breaker (5) closer to the temperature sensor, and a more-remote signal switch (4). In that case, for operating the remote signal switch, a flat bar-like transfer member (9) traverses both switches through openings (54). The transfer member is coupled at the associated end and in adjustable manner with an operating member (30) for the signal switch (4), receiving the adjustment member (34). The parts are constantly held together in clearance-free manner by the tension of a restoring spring (40).

39 Claims, 3 Drawing Sheets

TEMPERATURE LIMITER

BACKGROUND OF THE INVENTION

1. Field of the Invention

The invention relates to a temperture limiter with a rod-like temperature sensor, which operates at least one switch.

2. Prior Art

Such temperature limiters, which in general terms can be used as temperature switches, are particularly used where electrically heated equipment, such as electric hotplates, radiant heaters of glass ceramic cooking units, baking oven muffles and the like have to be protected against overheating. DE-OS 34 23 086 (U.S. Pat. No. 4,544,831) discloses a corresponding temperature limiter for regulating or limiting the temperature of radiant or contact heater bodies of electrical cookers insulating material tube is kept constantly under compressive stress by a compression spring acting on a rod within the base, because the outer end of the inner rod which is tensile-loaded by the spring, acts on the outer end of the insulating tube. The insulating tube is relatively brittle and therefore easily breakable, which on the one hand makes it difficult to introduce the compressive forces into its ends and on the other hand also leads to strength problems between the ends, because the insulating tube is bending-stressed. Thus, in this construction once again a relatively large diameter of the insulating tube is to be sought and in order to bring about a uniform introduction of the compressive forces there are end caps mounted on its ends, which leads to a very complicated construction and relatively large cross-sections. As the temperature sensor, e.g. when placed on radiant heaters, produces back-radiation or reflection, which increases with increasing temperature sensor diameter, in the case of the known construction there can be local overheating of the heating resistors as a result of this back-radiation. Admittedly the requirement of a relatively small diameter is usually met in the case of temperature sensors with a metallic outer tube, but the electrical conductivity of said outer tube is disadvantageous in many applications, so that on the metallic outer tube it is necessary to place a protective insulating tube, which leads to a very complicated construction and to an increase in the temperature sensor diameter.

SUMMARY OF THE INVENTION

An object of the invention is to provide a temperature limiter or the like of the aforementioned type which, in the case of simple construction and high operational reiability, permits a very slender, compact construction of the temperature sensor.

This object is achieved in the case of a temperature limiter of the aforementioned type as a result of the inventive construction. In a further development, despite electrically insulating enveloping, the inner rod of the temperature sensor only has to be surrounded by a single tube, which can in turn be made from a high temperature-resistant material with a low thermal expansion coefficient and high electrical insulating properties. As a result of the fact that it is exclusively tensile-loaded, said insulating tube can not only have a relatively small diameter, but can also be constructed with a relatively small wall thickness, so that the external width of the temperature sensor need only exceed by roughly two to three times the external diameter of the inner rod. The arrangement can also be such that the envelope surface defined by the outer face of the outer tube represents the outermost boundary of the temperature sensor over its entire length. No parts project to the outside, such as end caps and the like, over most of its length extending up to the outermost end of the temperature sensor. Moreover, as the inner rod is only pressure-loaded and can be relatively closely surrounded by the insulating tube, there is a very exact temperature-dependent movement of the inner end of the inner rod, resulting in a decisive switching process or processes.

The inventive construction is suitable for those temperature limiters only having a single switch, but also for temperature switches having two or more switching contacts, e.g. for different switching functions, which is the case where one switch as a circuit breaker controls the power of the heating means to be switched, whilst a further switch switches a signalling device as a hot indicating or signal switch, said device indicating whether the heated appliance does or does not have a temperature which is too high for contact, e.g. above 60° C.

A particularly advantageous further development in the case of rod sensors of any type results from rod parts attached to one another by means of a compressive force. The adjacent rod parts appropriately have different expansion coefficients, so that there is an articulated inner rod only held together under operational compressive forces, which ensures a very reliable passing along of the different length expansions of the different rod parts.

The inventive expansion rod sensor can also be very simply fitted, adjustably constructed and mounted in such a way that it can be positionally modified, e.g. in articulated manner with respect to the base for aligning relative to the heating system.

Temperature limiters with two or more switching functions are mainly used for the separate switching of two circuits, namely e.g. the power circuit of the heating means and a signal circuit for indicating the hot state of said heating means or an associated appliance area, but both switching processes can be controlled by a single temperature sensor. As a result it is relatively difficult to make the arrangement such that the switching point of the two switches can be precisely individually adjusted. In numerous electrical heating systems, such as e.g. electric hotplates, radiant heaters of glass ceramic cooking units, baking oven muffles and the like, such an adjustment is frequently required in such a way that even after the incorporation of the temperature limiter, adjustment can be simply performed.

DE-OS 34 23 086 (U.S. Pat. No. 4,544,831) discloses a temperature limiter for regulating or limiting the temperature of radiant or contact heating bodies of electrical cookers, in which the actuating member and the transmission member form a rotationally symmetrical, two-stage cylindrical component, whose larger portion forms an annular actuating face for one switch and its narrower portion with its end face forms a smaller actuating face for the other switch pointing in the same direction. The distance between these two actuating faces determines the adjustment for the switch more remote from the temperature sensor and must be fixed prior to the installation of said component by grinding the faces after which further adjustment is no longer possible. In addition, the arrangement is such that in the case of longitudinal expansion of the inner rod of the temperature sensor, the contacts of the more remote switch are closed and the transmission member no longer acts directly on the snap spring of the associated snap switch and instead acts on a relief spring loading same into the open position, which is prejudicial to a reliable and accurate switching function of said switch, also because said snap function is consequently largely put out of action.

DE-OS 28 38 161 admittedly discloses a temperature limiter, in which both switches can be simply adjusted subsequently in a substantially independent manner, but here the switches are juxtaposed at right angles to the temperature sensor, so that there is no direct linear operation of the two switches by the latter and instead crosswise transmission levers are provided.

In particular compared with these known constructions, the invention has the further object of providing a temperature limiter of the indicated type, which also permits subsequent or any-time adjustment of the switching point of the switch furthest from the temperature sensor.

This object is achieved by a temperature limiter of the aforementioned type in that for the adjustment there is a spacing change in two possible directions. Due to the fact that e.g. the distance from the actuating member to the pressure rod is adjustable with an adjusting member, it is possible to very accurately set the switching precision of the more remote switch. An adjusting member belonging to the inner rod of the temperature sensor and therefore provided for adjusting the switch closest to the temperature sensor, as well as the adjusting member belonging to the actuating member, can in simple manner be arranged successively in an extension of the temperature sensor, i.e. for example equiaxially to one another. A particularly advantageous construction is obtained if the parts of said adjusting members formed by e.g. operating knobs for operating said parts, are directed away from one another and are located on remote sides of the temperature limiter, e.g. at the outer end of the temperature sensor on the one hand and at the end of the base remote therefrom on the other.

Thus, in easily accessible manner, the adjusting members can be provided equiaxially to one another, so that all the forces to be transferred by the temperature sensor are in the form of purely compressive forces and no bending forces result. This in particular relates to the transfer of forces from the transmission member to the adjusting member and from the latter to the separate operating member, which is appropriately linearly movable substantially equiaxially to the transmission member. This leads to a direct action of the expansion or inner rod of the temperature sensor on the switches, which greatly increases the switching precision.

A particularly advantageous further development, particularly in the case of temperature switches of the described type, is obtained if the transmission member or the operating member has or have cross-sections differing from the cylindrical cross-section, because this on the one hand permits a more compact housing of said members and on the other it is possible to simply achieve an arrangement which is prevented from rotating with respect to the base. This non-rotation of the transmission member can be directly transferred for rotation preventing purposes to the actuating member, so that the latter does not require a direct rotation-preventing guidance with respect to the base, which makes the system easier to operate and also further increases the switching precision. Another advantage of this arrangement is that the operating member and the transmission member can be constructed with substantially the same shape or the same cross-sections, which on the one hand significantly facilitates manufacture when said two parts are made from separate, constructionally identical parts and are assembled to form a common component and on the other hand facilitates assembly, because both ends of said components can be arranged so as to act in the same way in both possible positions.

These and further features of the preferred further developments of the invention can be gathered from the description and drawings, in which the individual features can be realized alone or in the form of subcombinations in an embodiment of the invention and in other fields.

BRIEF DESCRIPTION OF THE DRAWINGS

Embodiments of the invention are represented in the drawings and are described in greater detail hereinafter relative thereto. In the drawings.

DETAILED DESCRIPTION OF THE PREFERRED EMBODIMENTS

Figure 1:
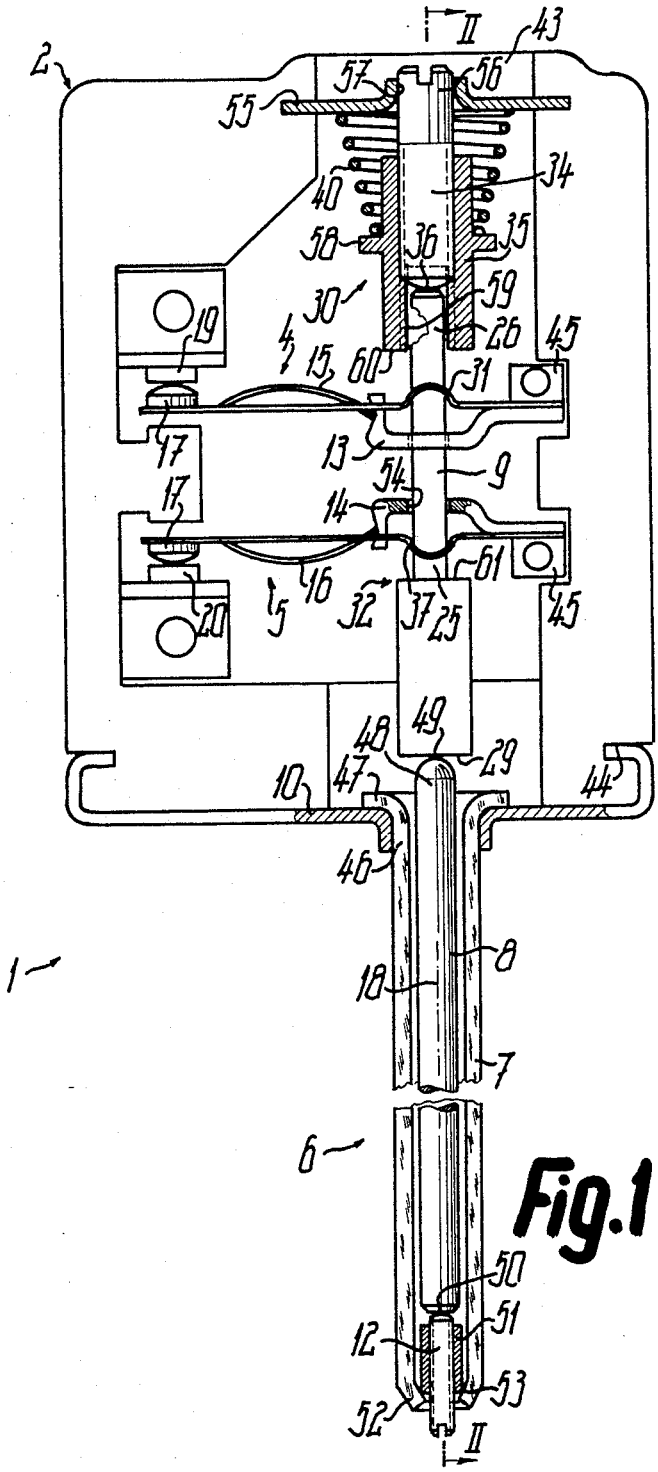
FIG. 1 is an inventive temperature limiter in a view with the casing open.
Figures 2, 3, 4, 5, 6:
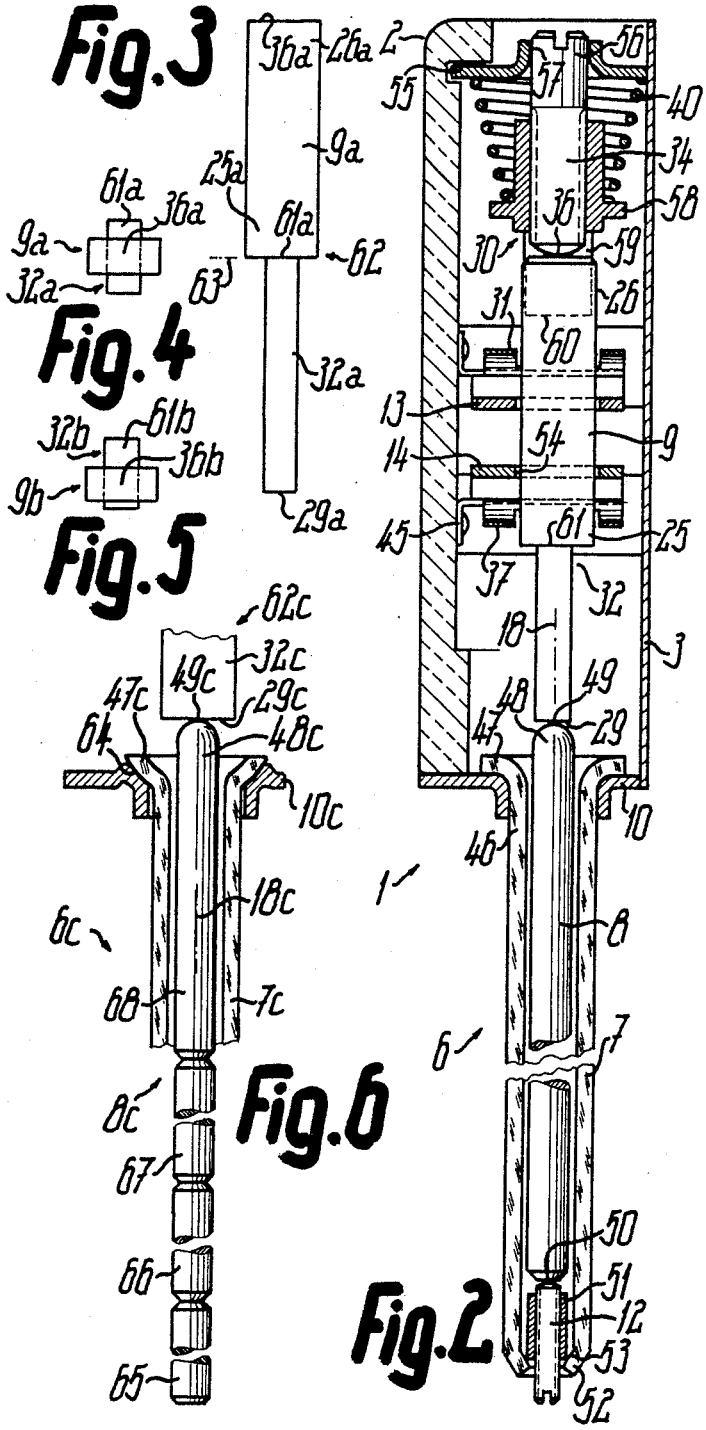
FIG. 2 is a section roughly along line II—II in FIG. 1.
FIG. 3 is a component of the temperature limiter in a further embodiment.
FIG. 4 is a plan view of the component according to FIG. 3.
FIG. 5 is another embodiment of the component in a representation corresponding to FIG. 4.
FIG. 6 is a detail of FIG. 2 in another embodiment.

The temperature switch shown in FIGS. 1 and 2, and which is preferably used as a temperature limiter 1, has an insulating material base 2 at the top or front, which can be opened and can be closed with a plate-like, planar casing cover 3. In the base are arranged in directly adjacent, successive manner, two constructionally identical switches in the form of snap switches having the same external dimensions. These switches can be used for random separate switching processes and are preferably provided as circuit breakers 5 and as signal switches 4 in such a way that the circuit breaker 5 switches off the power of the connected heating system above a temperature predetermined by adjustment, whilst the signal switch 4 is used at an adjustment-predetermined, relatively low temperature of the heated appliance to switch on a signaling device, e.g. a signal light and is only switched off again on dropping below said second temperature. Base 2 is constructed as a substantially closed housing, which surrounds and protects the switches on all sides.

On a socket like narrow side located on the circumference of the flat rectangular base 2 is fixed a rod-like, linear temperature sensor 6, which is significantly longer than the longitudinal sides of base 2 parallel to its longitudinal direction and is substantially parallel to the median plane of base 2 located between the front and back. Temperature limiter 6 is closer to the front than to the closed back of base 2 parallel to the front.

Substantially over its entire length, temperature sensor 6 is made from a high temperature-resistant material with a very low thermal expansion coefficient and made in the form of an outer tube 7, which in particular has electrical insulating characteristics and is preferably made from quartz glass, ceramic or the like, as well as an inner rod 8, which is arranged in substantially contact-free manner in outer tube 7 and has a much larger expansion coefficient than the latter. Outer tube 7 and inner rod 8 are in each case approximately cylindrical over their entire length, the external diameter of inner rod 8 being smaller by much less than half its diameter than the internal diameter of inner tube 7, so that between these two parts there is only a relatively narrow gap spacing and the external diameter of the relatively thick-walled outer tube 7 is relatively small, e.g. approximately the same as the diameter of helical heating resistors, which are provided in the heating system associated with temperature limiter 1.

The inner end 46 of outer tube 7 at base 2 is shaped to form an engaging member 47 constructed in one piece therewith and only projecting radially outwards in the form of a ring flange, which is consequently constructed in one piece with outer tube 7. This inner end 46 of outer tube 7, which extends into the base 2, is substantially centered in a flange plate 10, which forms the entire associated, narrow-side casing wall of base 2.

This metallic flange plate 10 has an outwardly projecting shoulder traversed by the inner end 46 of outer tube 7, the engaging member 47, having the same or a greater thickness than flange plate 10 engaging on the inside of said flange plate directly adjacent to the opening. The transition from the engaging member 47 into the casing of outer tube 7 is on the outside thereof cross-sectionally pitchcircle like, concavely curved and is substantially engaged on the corresponding convex transition area between the opening and the inside of the flange plate 10, in the same way as the planar, annular end face of engaging member 47 engages substantially in whole-area manner on the inside of flange plate 10. This leads to relatively limited specific surface pressures. The substantially elongated-rectangular flange plate 10 is provided on its ends associated with the longitudinal sides of base 2 with U-shaped-bent border profiles, whose oppositely directed U-legs remote from the flange plate 10 engage positively in holding slots 44 on the longitudinal sides of base 2 by insertion from the front thereof.

The inner end 48 of the inner rod 8 having constant cross-sections and being free from threads or collar projects only slightly over the inner end face of outer tube 7, namely by only approximately one to four times its diameter and with its spherically curved end face is centrally engaged on the polygonal transfer surface 29 of a flat profile-like operating member 32 forming with a transfer member 9 connected to its other end and having roughly the same cross-section a one-part component.

With its outer end face 50, the inner rod 8 engages under spring tension on an end face of an adjusting member 12 approximately equiaxial thereto, said adjusting member 12 being axially positively supported under said spring pressure only in the associated direction with respect to the outer tube 7. The end face 50 is admittedly shown as a planar face and the corresponding end face of adjusting member 12 as a spherical face, but both end faces of the inner rod 8 can be identical, so that they can be inserted in outer tube 7 so as to act in the same way in both the possible turning positions. If these end faces are spherical, then the two opposite faces provided for them are appropriately planar, whereas said opposite faces are appropriately spherical if the end faces of inner rod 8 are substantially planar.

The adjusting member 12 on which inner rod 8 engages within the outer tube 7, is guided in a threaded, sleeve-like intermediate member 51 within said outer tube 7 and which has over its length constant cross-sections and whose external width is smaller than the internal width of the outer tube 7, namely approximately the same as the external width of inner rod 8.

The outer end portion 52 of outer tube 7 is frustum-shaped-tapered over a short length and consequently forms an inner, annular stop face 53, against which the intermediate member 51 engages with its outer end face in axially secured manner under the spring tension. These interengaging surfaces are e.g. made such by flattened parts, claw profiles, self-locking conical construction, etc., that they lead to the prevention of rotation between intermediate member 51 and outer tube 7.

The adjusting member 12 constructed as a stud projects beyond both ends of the intermediate member 51 and its outer end can project out of outer tube 7 for easy accessibility. For fitting the adjusting member 12, it merely has to be so-to-speak thrown through the inner end of outer tube 7 as an assembly with intermediate member 51, it then loosely engaging on stop face 53 and is secured in this position by inserting inner rod 8. The two switches 4,5 have in each case a multiple angled, strip-like switch carrier 13 or 14 constructed as a stamped bending part and which is provided with a snap spring 15,16 constructed as a leaf spring and which carries or forms at its free end a switching contact 17. The two identically constructed, but oppositely directed switch carriers 13,14, including their snap springs 15,16, are substantially mirror symmetrical to a median plane at right angles to the central axis 18 of temperature sensor 6 or to its operating direction, in such a way that the snap springs 15,16 are located substantially on the remote sides of switch carriers 13,14. With the switching contacts are associated casing-fixed opposite contacts 19,20, which form part of connection parts (not shown) projecting beyond the outside of base 2 and e.g. in the form of connectors or are electrically conductively connected to such connecting parts. Corresponding, connecting parts or connectors (not shown) are electrically conductively connected to the switch carriers 13,14, said connecting parts being inserted in slots of base 2 and consequently can form the fastening of the particular switch carrier. In the represented embodiment, the switch carriers 13,14 are fixed with bent fastening lugs 45 in base 2.

The transfer or transmission member 9 or operating member 32, made from an electrically non-conducting insulating material, is not directly guided on base 2 and is instead completely contact-free with respect thereto and is merely guided in that the transfer member 9 passes through openings 54 in switch carriers 13,14, whereby at least one of these openings 54 is adapted to the cross-section of transfer member 9 for forming a sliding guide and the openings 54 are at right angles to the longitudinal direction of snap springs 15,16.

The transfer member 9 also passes completely through the switch 4 furthest from the temperature sensor 6 and is so coupled by its free end to a separate, sleeve-like operating member 30, that it directly and positively carries along the latter during movements away from the temperature sensor 6, but does not itself contact the associated operating counter-member 31 of the adjacent switch 4 in the sense of actuation. This operating counter-member, which is substantially formed by a cross-sectionally pitch circle-like articulation fin stamped out of the snap spring and which projects towards the operating member 30 and substantially traversed by transfer member 9 in contact-free manner in the vicinity of an opening symmetrical thereto, for operation purposes is exclusively contacted by the operating member 30, in the vicinity of at least one longitudinal boundary of the opening which is narrower than the thin width. This contact takes place laterally outside the outer face or faces of the transfer member 9 and namely laterally outside the wider outer faces thereof.

Operating member 30 and transfer member 9 engage in one another in the manner of a telescopic rod and preferably the operating member engages over the transfer member on the outer circumference in an at least partial manner, i.e. at least over part of its circumference, so that said operation of switch 4 can take place in a very simple manner. The operating member 30 acting on switch 4 in the disconnection direction has a rigid construction, so that the switching function is very precise. The operating member engages in clearance-free manner with a restoring spring 40 against the transfer member 9 and said spring 40, apart from the switch springs only acting on disconnection, is the only spring acting on operating member 30, transfer member 9, operating member 32, inner rod 8 and adjusting member 12, which holds together all these parts in the manner of an articulated pressure bar in each functional position, under pressure and in clearance-free manner.

The surface of the operating member 30 acting on transfer member 9 is provided on an adjusting member 34 in the form of a stud, which is so screwed into a corresponding internal thread of operating member 30, that its spherical face facing the inner rod 8 is located within operating member 30 in any adjustment position and over said face always projects a longitudinal portion of the operating member 30, in which the associated end of the transfer member 9 engages in longitudinally guided and positively rotation-prevented manner. Thus, the operating member has a longitudinal extension and is located therewith roughly parallel and in particular aligned to the transfer member 9 and/or the adjustment member 34, so that there is a very compact arrangement, which functions very accurately, even in the case of numerous switching cycles.

As a result of the described construction, adjustment member 34 engages with a pressure surface, namely particularly its end face on a transfer surface 36, namely particularly on the associated end face of transfer member 9 in clearance-free manner in any position of the latter. This end face 36 is appropriately identically constructed to end face 49 of operating member 32, but can also be spherical, particularly in the case of a planar construction of the pressure surface of adjusting member 34.

Due to the fact that the operating member 30 and transfer member 9 are coupled together within the operating member 30, there is a protective, dirt-preventing position of the engaging and adjustment-determining surfaces, namely the pressure surface and transfer surface 36. The rotation prevention of operating member 30 could also take place with respect to the base, but a much smaller friction-inducing arrangement is obtained if the longitudinal guidance is provided between the operating member 30 and the transfer member 9.

Operating member 30 is guided by two measures, namely by the suspension on spring 40 and by guiding in a base plate 55, but it would be conceivable to provide only one of these two measures. The guidance in base plate 55 forms a sliding guide with respect to base 2 and is preferably formed in that a cylindrical end portion 56 of adjustment member 34 held in thread-free manner as a sliding bolt and projecting over operating member 30 engages in centered manner in a bearing opening 57 of base plate 55. The base plate 55 spaced from the associated end of operating member 30 forms bearing opening 57 with a shoulder directed away from member 30.

The base plate 55, with two-sided, laterally positioned marginal zones, is inserted from the front of base 2 in opposite slots in the associated casing inner faces of said base 2 and is secured in the fitted position by the casing cover 3 engaging thereon with its inside. The base plate 55, whose bearing opening 57 is closed by end portion 56, forms on the associated side of base 2 the closing plate for the casing inner space or a corresponding casing wall and is appropriately made from roughly equally thick sheet metal in the same way as flange plate 10. Due to the fact that the casing inner area of base 2 is closed on two facing narrow sides on the one hand by flange plate 10 and on the other by base plate 55, it is possible to very simply manufacture the base 2 from insulating material.

A certain mounting and guiding of operating member 30 by the restoring spring 40 is obtained in that said spring, which is in particular roughly equiaxial to transfer member 9, is constructed as a frustum-shaped compression spring engaging with a tapered, annular end both substantially on the circumference and on an outwardly projecting collar 58 of operating member 30, said collar 58 being provided roughly in the center of the length of operating member 30. The other, extended end of restoring spring 40 appropriately engages on the inside of base plate 55, so that no separate abutment is required. Thus, apart from its connection to adjustment member 34 or restoring spring 40, operating member 30 is arranged in substantially contact-free manner with respect to the base-fixed surfaces.

The outer end of adjustment member 34, which is located within base 2, is at all times easily accessible from the outside of base plate 55. On the side of collar 58 facing the temperature sensor 6 the operating member 30 is provided with a longitudinal slot 59 traversing it on two diametrically facing sides and the width of said slot is adapted to the profile thickness of the flat, rectangular cross-section of end portion 26 of transfer member 9. The inside width of operating member 30 is smaller and the outside width roughly the same as the profile width of end portion 26 which is greater than the profile thickness, so that said end portion engages in guided manner in two opposite parts of the longitudinal slot 59.

Operating member 30 and operating member 32, as a result of the described construction are successively arranged in the longitudinal direction of transfer member 9 and have two facing operating faces 60,61. Operating surface 60 of operating member 30 is formed by the sleeve end face located on either side of longitudinal slot 59 and traversed by the latter, whilst operating face 61 of operating member 32 is formed by a radial shoulder face projecting by roughly the same amount as operating face 60. As the transfer member 9 or operating member 32 is guided in rotation-prevented manner in at least one of the switch carriers 13,14 by positive sliding guidance, the operating member 30 is also arranged in rotation-prevented manner with respect to the base.

Transfer member 9 or operating member 32 can also have cross-sections other than flat, rectangular cross-section, e.g. an oval, square or similar cross-section, but in order to be arrangeable in each case symmetrically to a common central axis and to be able to have at least approximately the same or identical cross-sections, have at least partial cross-sections differing from circular cross-sections, which consequently have differently large radial extensions in the circumferential direction. Thus, in simple manner projecting operating faces 61 of operating member 32 can be obtained in that the latter and the transfer member 9 are turned with respect to one another about the common longitudinal axis, i.e. are not aligned with respect to their cross-sections. Nevertheless, the transfer member 9 and the operating member 32 can have roughly the same maximum radial extensions with respect to a common central axis, so that a very space-saving arrangement is possible. In the represented embodiment, the transfer member 9 and the other member 30 are rotated by 90° with respect to one another, so that on either side the operating surfaces 61 project over the flat sides of transfer member 9, whilst the narrow sides of the latter project in the same way over the flat sides of operating member 32.

As shown in FIG. 3, the transfer member **9*a* and operating member 32*a*, which form a common component 62, can be made equally long in such a way that their transfer surfaces 36*a*,29*a* are located at identical longitudinal spacings from the centre of the length of said component 62, i.e. from its transverse median plane 63. The end faces of transfer member 9*a* and operating member 32*a* remote from the transfer surfaces 29*a*, 36*a* are also symmetrical to the transverse median plane 63 and are namely in the same, so that both end faces can be randomly used as the operating face 61*a*. Thus, component 62 can be mounted in base 2** as a reversible component so as to act in the same way in two positions rotated by 180° to one another, so that there is no need to respect a particular position, which greatly facilitates automatic assembly.

As can be gathered from FIG. 4, transfer member **9*a* and operating member 32*a* are in longitudinal view symmetrical to one another, so that each of these two parts projects to the same extent over the other to either side. However, according to FIG. 5, it is conceivable for at least one of these parts and in the represented embodiment the transfer member 9*b* to be slightly displaced with respect to the center of the other component, namely operating member 32*b*, so that the latter projects further over one flat side of transfer member 9*b* than over its other side. The arrangement is appropriately such that the operating member 32*b* is displaced away from the side of base 2 on which the switching contacts 17** are located, so that it requires less space on this side and the casing inner area can be made correspondingly narrower.

Otherwise FIGS. 3 to 8 use for corresponding parts the same reference numerals as in the other drawings, but followed by different letter references.

The described construction leads to a temperature switch, in which the switch 4 is protected against excessive stressing by overpressures, because the operating member 30 only has to act during the return travel, i.e. with the sensor temperature decreasing and namely leaves switch 4 unloaded, when the latter is switched on.

Compared with the construction according to DE-OS 34 23 086 (U.S. Pat. No. 4 544 831) the inventive construction has important advantages. In the known solution there is no adjustability of the reciprocal spacing of the operating surfaces and this is not possible, because on the one hand there is no constant engagement of the operating member on the associated operating counter-member and on the other the operating surfaces point in the same direction, so that the operating surface of the operating member presses over the associated signal switch at an excessive temperature and consequently leads to at least a misadjustment and possibly even to damage.

Moreover, in said known arrangement, the inner rod is not constructed as a pressure rod and is instead connected as a tension rod to the outer tube, which leads to a complicated construction and to the disadvantage that the switching precision is also dependent on the reliability of a spring placing the inner rod under tension. Compared with the construction according to DE-OS 28 39 161, there is inter alia the advantage that the switches are successively arranged and are so directly operated, that the imprecisions due to internal deformation are substantially avoided, although in this known solution both switches are directly adjustable.

As a result of the non-cylindrical shape of transfer member 9 on the one hand and operating member 32 on the other, there are significant advantages with respect to the mounting, the spatially favorable housing, assembly and operational reliability. The inventive construction can also take account of the fact that for installation and electrical connection reasons it is generally more favorable if the switch 5 closer to the temperature sensor 6 is the circuit breaker, because then also the connection parts associated with said switch 5 and located on the outside of base 2 are located closer to the heating system to be switched than the corresponding connection parts of the other switch 4, which is generally a circuit breaker.

As shown in FIG. 6, the outer tube **7*c*, constructed as an insulating tube, can be mounted in articulated manner within a narrow swivel angle appropriately about at least one axis intersecting at right angles its central axis 18*a* and preferably about an articulation point located roughly in its central axis 18*c*** in all directions, so that it can give way in the case of overloading and can be very precisely aligned on incorporating the temperature switch.

In the represented embodiment, the engaging member provided at the inner end of insulating tube **7*c* is constructed as a circular part cup 47*c*, whilst the flange plate 10*c* on the inside is constructed as a complementary, spherical bushing 64, which surrounds the through-opening for the inner end 46*c* of the insulating tube 7*c*. Under the pressure of the restoring spring, the part cup engages in bushing 64 with such a great friction, that the set swivel position of the temperature sensor 6*c* is fixed by self-locking. The swivel axis or the sphere center of the bearing faces can be appropriately located in the contact face between the inner end 48*c* of inner rod 8*c* and transfer surface 29*c***, so that the adjustment is not modified by pivotal movements.

The through-opening in flange plate **10*c* is larger than the external width of the portion of insulating tube 7*c* located therein, in accordance with the maximum swivel angle of temperature sensor 6*c***. In the case of a construction according to FIGS. 1 and 2, it is also conceivable to provide a limited pivotability of temperature sensor 6 with respect to base 2.

As is also shown in FIG. 6, the inner rod or the part of the temperature sensor having the greater expansion coefficient and which is therefore more appropriately pressure-loaded or pressure-loading, comprises at least two longitudinally connected portions, which with respect to their length, cross-section and expansion action are so matched to different zones of the heating system to be measured that one or more zones do not or only slightly influence the temperature value sensed by the sensor, whereas one or more further zones largely influence said value and therefore despite the extension of the temperature sensor over both types of zones constitute the representative measuring zones. Successively positioned or generally directly adjacent-connected portions of the inner rod appropriately have different expansion coefficients or said portions are made from different materials, the thermal expansion coefficient of one type of portion being appropriately close to the range of the expansion coefficients of outer tube 7c. Thus, said portions purely mechanically and thermally form substantially inactive transfer portions between the other, thermally active portions on the one hand and for the transfer of length changes to the switch or switches on the other.

It is also conceivable to subdivide the outer tube in a corresponding manner, but this would only then be relatively simply performable if the outer tube were pressure-loaded in each operating position. Thus, a particularly simple and advantageously reliably operating embodiment for any type of rod sensor is obtained if in the case of an inner rod having at least two longitudinally following, separate rod parts, adjacent rod parts are formed by separate portions pressure-engaging in the longitudinal direction of the inner rod, which preferably has the same cross-sections and/or roughly the same length, so that there is no need for a direct, tension-loadable fixing of adjacent rod parts to one another, as is conceivable.

As can be gathered from FIG. 6, there are three separate measuring range portions 65,66,67 of the inner rod 8c of the temperature sensor 6c for the longitudinal section of the temperature sensor 6c intended for arrangement in the heated area of the heating system to be switched. This longitudinal section is spaced from at least one end of the temperature sensor 6c and is in particular spaced from its base-side end, so that in the associated residual longitudinal section of the temperature sensor 6c is provided a rod end portion 68, which is constructed as a thermally substantially inactive portion and merely serves as a transfer member. This end portion 68 can, as a function of requirements, be connected to a thermally inactive or a thermally active portion 67.

The thermally inactive portions are appropriately made from ceramic or a material with similar characteristics, whilst the thermally active portions are appropriately made from a metallic material. The end portion 68 is in one piece throughout. Adjacent portions are appropriately not connected in punctiform or articulated interengaging manner with one another and are instead so placed against one another that they bring about an optimum reciprocal alignment, which can e.g. be achieved by planar, engaging faces or in that the interengaging ends have a complementary conical construction. Through the inside width of outer tube 7c being relatively closely adapted to the outer width of the inner rod, a slightly bent configuration of adjacent portions is not disadvantageous, unless a particularly high measuring accuracy is required.

Figure 7:
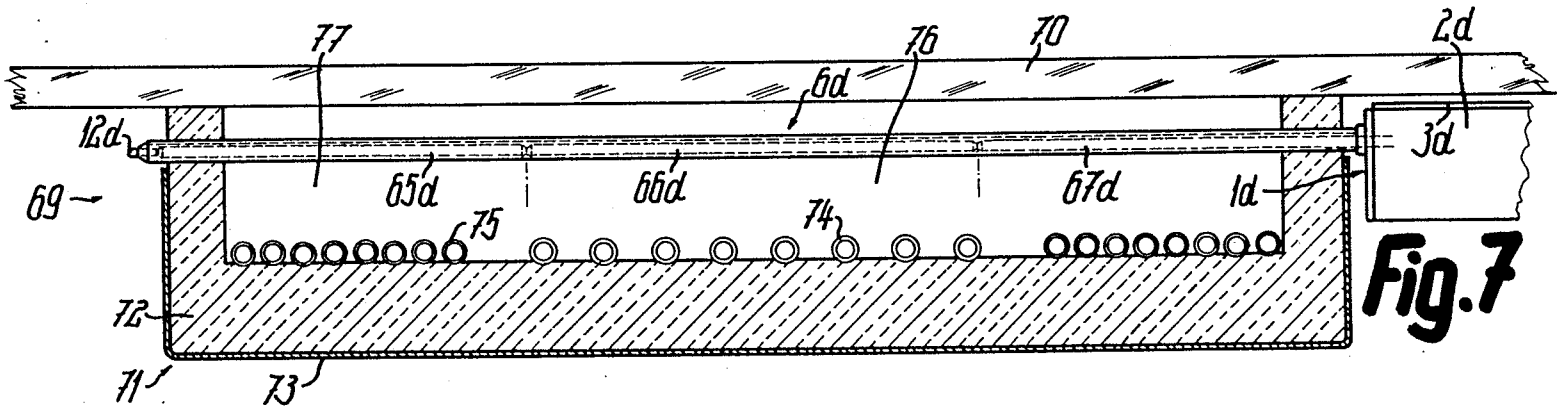
FIG. 7 is another embodiment of a temperature limiter in an operating arrangement.

FIG. 7 shows the association of an inventive temperature limiter 1d with a heating system 69, which can be the heating system of a radiant heater for the cooking field of a cooker, a baking oven muffle or the like and is to be arranged on the bottom or outside of a hotplate 70, e.g. a glass ceramic plate.

Heating system 69 has a dish-shaped carrier 71, which essentially comprises an inner insulating dish 72 made from compressed insulating material and an outer support dish 73 made from sheet metal of the like. On the bottom of the insulating shell 72 are arranged separately switchable heating resistors 74,75 in the form of e.g. overhung resistance wire coils, which form separate heating fields 76,77. In the represented embodiment a heating resistor 74 spirally laid in a central field forms a central heating field 76, which is surrounded in annular manner by the second heating field 77 and here again at least one heating resistor 75 is spirally wired. The heating fields 74,75 can also be reciprocally defined by an annular intermediate wall, which projects over the bottom of insulating dish 72 approximately up to the temperature sensor 6d or up to hotplate 70, which is made from insulating material and which surrounds the inner heating field 74.

Temperature limiter 1d is arranged in such a way that its base 2d outside heating system 69 or carrier 71 is located directly on its outer circumference and its casing cover 3d is adjacent to the bottom or outside of hotplate 70. Temperature sensor 6d projects approximately diametrically through the border of carrier 71 into the heating system and with its end remote from base 2d traverses the opposite area of the border of carrier 71 in an at least partial manner. Temperature sensor 6d is parallel to hotplate 70 between the latter and heating resistors 74,75.

The length of the central portion 66d of the inner rod of the temperature sensor 6a located in the vicinity of heating field 76 corresponds to the length by which the temperature sensor 6d covers said heating field 76. Portion 66d is constructed as a thermally active portion, whilst the two connecting portions 65d, 67d cover the annular heating field 77 and are constructed as thermally inactive portions. One end portion 75d extends up to adjustment member 12d, whilst the other portion 67d extends into base 2d.

The switching of the heating resistors is such that the heating resistor or resistors 75 of the outer heating field 77 can randomly switch in to the heating resistor 74 of central heating field 76, i.e. during the operation of heating system 69 the central heating field 76 is always heated. As only this heating field 76 thermally influences temperature sensor 6d, the operating precision of temperature limiter 1d is equally good, no matter whether the outer heating field 77 is connected in or not. As at least over portions of its length the inner rod has a greater expansion coefficient than the outer tube or the insulating tube, the inner rod is always compressively loaded, whereas the outer tube is always tensile-stressed.

Figure 8:
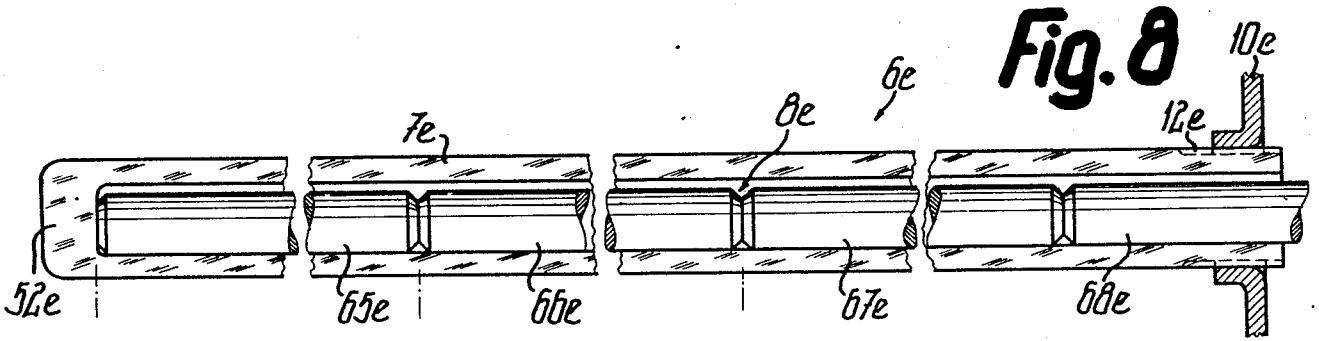
FIG. 8 is another embodiment of a temperature sensor in axial section.

As can be gathered from FIG. 8, the outer or insulating tube 7e of the temperature sensor 6e can be substantially closed at the outer end by an end wall 52e and can consequently form a direct pressure support for the associated end of the inner rod 8e, so that no adjustment member is provided in this area. In this case, the adjustment member 12e is located in the vicinity of the base-side end of outer tube 7e, said end being appropriately constructed in such a way that it longitudinally adjustably engages in the base or in flange plate 10e. As shown in FIG. 8, e.g. said end of outer tube 7e can be provided with an external thread, which engages in a corresponding internal thread of flange plate 10e with such great friction, that there is no need to fear a manual accidental turning of outer tube 7e during assembly or the like. The arrangement is appropriately such that for the adjusting turning of the outer tube 7e it is necessary to use a tool, which must be attached to an engaging member, e.g. on key faces, a diametral slot or the like at the outer end of outer tube 7e.

Compared with the construction according to DE-OS 33 33 645, in which the inner rod is formed from several partial rods having identical expansion coefficients, the inventive construction has the advantage that the temperature sensor can be constructed in such a way that random longitudinal portions can participate in random differing manner in the expansion behavior. Compared with the construction according to EP-A-O No. 116 861,the inventive construction has the particular advantage that the thermally active portion is located in the vicinity of a heated zone and that adjacent portions only have to be interconnected by engaging against one another.

We claim:

1. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor; and, an insulating means directly surrounding the inner rod member and providing an abutment for said outer end portion of the inner rod member, and wherein said insulating means is provided by said outer tube being an insulating member, said inner rod manner being constructed as a pressure rod provided for transferring compressive forces, said inner rod member being supported on said insulating member provided for tensile-stress under the compressive forces of said inner rod member, said insulating member having an inner end portion fixed to the base member and an outer end portion, means being provided for fixing said inner end portion of said insulating member to prevent movement in a direction towards the outer end portion.

2. The temperature limiter according to claim 1, wherein the inner end portion of said insulating member forms an engaging member constructed in one piece with the insulating member and defining a widened ring flange for engaging said base member.

3. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor; and, an insulating means directly surrounding the inner rod member and providing an abutment for said outer end portion of the inner rod member, and wherein said insulating means is provided by said outer tube being an insulating member, said inner rod member being constructed as a pressure rod provided for transferring compressive forces, said inner rod member being supported on said insulating member provided for tensile-stress under the compressive forces of said inner rod member, said insulating member having an inner end portion fixed to the base member and an outer end portion, means being provided for fixing said inner end portion of said insulating member to prevent movement in a direction towards the outer end portion, said outer end portion of said inner rod member being supported against said insulating member via an intermediate member and an adjustment member, said insulating member defining an insulating tube, said inner rod member being located within said insulating tube.

4. The temperature limiter according to claim 3, wherein said intermediate member carries an adjusting screw, said intermediate member and said adjusting screw forming an assembly inserted loosely in said insulating member, means being provided for pressing said assembly against an inner stop face of said insulating member via said inner rod member.

5. The temperature limiter according to claim 4, wherein said stop face is formed by an inner shoulder of a frustum-like portion of said insulating member, said frustum-type portion by a narrow portion thereof defining the outer end portion and an outer end face of said insulating member.

6. The temperature limiter according to claim 3, wherein said intermediate member is constructed as an internal thread sleeve having substantially a same external cross-section as the inner rod member.

7. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor; and, an insulating means directly surrounding the inner rod member and providing an abutment for said outer end portion of the inner rod member, and wherein said insulating means is provided by said outer tube being an insulating member, said inner rod member being constructed as a pressure rod provided for transferring compressive forces, said inner rod member being supported on said insulating member provided for tensile-stress under the compressive forces of said inner rod member, said insulating member having an inner end portion fixed to the base member and an outer end portion, means being provided for fixing said inner end portion of said insulating member to prevent movement in a direction towards the outer end portion, means being provided for pivotably mounting said insulating member with respect to said base member within a narrow swivel angle, said means providing a sectional spherical bearing portion engaging in a bushing.

8. The temperature limiter according to claim 1, wherein said inner rod member provides a number of length portions, at least one of said length portions having a greater expansion coefficient than said insulating member.

9. A temperature limiter according to claim 1, wherein said inner rod member has at least two longitudinally chained, separate rod length portions, adjacent ones of said rod length portions being provided by separate portion parts pressure-engaging in a direction of longitudinal extension of said inner rod member, at least one of said rod length portions having a greater expansion coefficient than said insulating member.

10. The temperature limiter according to claim 1, wherein said inner rod member comprises at least two longitudinally following length portions having different expansion coefficients by being made from different materials, at least one of said length portions having a greater coefficient than said insulating member.

11. The temperature limiter according to claim 10, wherein at least one length portion of a plurality of length portions of the inner rod member is constructed as a thermally substantially inactive portion at an end, said portion having substantially a same expansion coefficient as the insulating member.

12. The temperature limiter according to claim 1, wherein at least one end portion of said inner rod member of said temperature sensor is located at said base member, said at least one end portion being constructed as a thermally substantially inactive, one-part transfer portion extending substantially up to an associated operating member.

13. The temperature limiter according to claim 1, wherein a heater having separate heating zones is thermally connected to said temperature sensor via said insulating member, different length portions of said inner rod member being thermally associated with separate heating zones of said heater.

14. The temperature limiter according to claim 13, wherein a length portion having a first expansion coefficient is responsive to a central heating field, two length portions on either side of said length portion having the first expansion coefficient, at least one of said two length portions having a different second expansion coefficient and being responsive to an outer, circular heating field, said heater including a radiant heater.

15. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor, wherein said switch means comprises at least two switches operated by said temperature sensor, an inner end portion of said inner rod member operating a first operating member provided for operating at least one first switch of said at least two switches, said inner end portion operating a second operating member provided for operating at least one second switch of said at least two switches, said first and second operating members engaging on operating counter-members of said at least two switches providing switch assembly parts, at least one of said switch assembly parts having an opening at least partly traversed by a transfer member provided for operating said second operating member, said first operating member being located closer to said temperature sensor than said second operating member, said transfer member being formed by a component connected to said inner rod member, said second operating member being coupled to said transfer member and being guided in an oriented manner by a restoring spring, said first and second operating members having two facing operating faces, an adjustment member for adjusting said first and second operating members with respect to each other being mounted with said second operating member and having an adjusting thread.

16. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor, wherein said switch means comprises at least two switches operated by said temperature sensor, an inner end portion of said inner rod member operating a first operating member provided for operating at least one first switch of said at least two switches, said inner end portion operating a second operating member provided for operating at least one second switch of said at least two switches, said first and second operating members engaging on operating counter-members of said at least two switches providing switch assembly parts, at least one of said switch assembly parts having an opening at least partly traversed by a transfer member provided for operating said second operating member, said first operating member being located closer to said temperature sensor than said second operating member, said first and second operating members being located at a distance with respect to each other, means being provided for varying said distance, said means having a displaceably mounted adjustment member.

17. The temperature limiter according to claims 15 or 16, wherein said second operating member and said transfer member engage in one another in the manner of a telescopic rod, said second operating member substantially at least partly overlapping said transfer member on an outer circumference.

18. The temperature limiter according to claim 16, wherein said second operating member is a rigid body fixedly positioned in clearance-free manner with respect to said transfer member by means of a restoring spring provided for tensioning said transfer member in any position against said inner rod member.

19. The temperature limiter according to claim 16, wherein said adjustment member is mounted to said operating member, said adjustment member substantially being provided by an adjusting screw engaging in an internal thread sleeve located substantially within said operating member.

20. The temperature limiter according to claims 15 or 16, wherein said second operating member has a longitudinal extension substantially aligned with respect to said transfer member and said adjustment member.

21. The temperature limiter according to claim 16, wherein said adjusting member has a pressure end face engaging in clearance-free manner on a transfer end face of said transfer member in any position of the transfer member.

22. The temperature limiter according to claim 15, wherein said second operating member and said transfer member are coupled to one another inside the second operating member, said two operating faces being a pressure face and a transfer face engaging on one another inside said operating member.

23. The temperature limiter according to claim 16, wherein said second operating member is rotationally secured by means of a longitudinal guide with respect to said transfer member and said base member, said longitudinal guide being substantially exclusively provided between said second operating member and said transfer member.

24. The temperature limiter according to claims 15 or 16, wherein said second operating member is guided with respect to said base member in a sliding guide substantially aligned in a longitudinal direction of said second operating member.

25. The temperature limiter according to claim 16, wherein an end portion of said adjustment member is constructed as a sliding bolt projecting beyond said second operating member and engages in a bearing opening of a base plate inserted in said base member, said base plate forming a closing plate and a casing wall for a casing space at an associated side of the base member, the base member being casing-like.

26. The temperature limiter according to claims 15 or 16, wherein said second operating member is guided in an oriented manner by a restoring spring substantially equiaxial with said transfer member, said restoring spring being substantially supported with an annular end on a circumference defined by a collar of said second operating member.

27. The temperature limiter according to claims 15 or 16, wherein said base member has base-related surfaces, said second operating member being arranged in contact-free manner with respect to said base-related surfaces except for connections via said adjustment member and said restoring spring.

28. The temperature limiter according to claim 16, wherein said second operating member and said first operating member are arranged successively in the longitudinal direction of said transfer member, said first and second operating members having two facing operating faces.

29. The temperature limiter according to claim 15, wherein a second one of said operating faces formed by a sleeve end face of said second operating member, said sleeve end face projecting laterally one said adjustment member, a first one of said operating faces being formed by a radial shoulder face of said first operating member, said shoulder face projecting substantially as far as the sleeve end face.

30. The temperature limiter according to claim 16, wherein one of said transfer member and said operating member is guided in non-rotary manner with respect to said base member substantially by a positive sliding guide of said transfer member in switch carriers of said switch means.

31. The temperature limiter according to claims 15 or 16, wherein said switch means comprises snap springs, said transfer member traversing said snap springs in substantially contact-free manner in the vicinity of fin-like, stamped-out operating counter-members provided by said snap springs.

32. The temperature limiter according to claim 16, wherein one of said transfer member and said operating member has a polygonal cross-section.

33. The temperature limiter according to claim 16, wherein said transfer member and said operating member have substantially identical cross-sections displaced with respect to one another about a common longitudinal axis.

34. The temperature limiter according to claim 16, wherein said transfer member and said operating member are formed by a common component, having on either side with respect to a transverse median plane substantially equally spaced transfer surfaces for a connection to said inner rod member and said operating member, as well as oppositely directed operating faces for an alternate engagement in said operating counter-member of said first switch, said operating faces being located substantially in said transverse median plane.

35. The temperature limiter according to claims 15 or 16, wherein said transfer member and said operating member are formed by two substantially equally long profile portions forming a common component operable in two oppositely turned mounting positions.

36. The temperature limiter according to claim 16, wherein said operating member has at least one longitudinal slot for engaging an associated profile end for said transfer member.

37. The temperature limiter according to claim 16, wherein one of said at least two switches of said switch means is constructed as a power controlling switch located closer to said temperature sensor than another one of said switches, said power controlling switch being operatively associated with said operating member, the other one of said switches being located more remote from said temperature sensor and being constructed as a signal switch associated with said second operating member provided to be adjustably mounted.

38. The temperature limiter according to claims 1, 3, 7, 15 or 16, further comprising a glass ceramic heating unit for said heating system, the glass ceramic heating unit being thermally connected to said temperature sensor.

39. A temperature limiter for a heating system, comprising:

a base member;

a substantially rod-like temperature sensor having at least one outer tube and an inner rod member arranged in said outer tube, said outer tube and said inner rod member having different thermal expansion coefficients, said inner rod member having an outer end portion remote from said base member;

at least one switch means arranged on said base member and provided for operation by said temperature sensor, wherein said switch means comprises at least two switches operated by said temperature sensor, an inner end portion of said inner rod member operating a first operating member provided for operating at least one first switch of said at least two switches, said inner end portion operating a second operating member provided for operating at least one second switch of said at least two switches, said first and second operating members engaging on operating counter-members of said at least two switches providing switch assembly parts, at least one of said switch assembly parts having an opening at least partly traversed by a transfer member provided for operating said second operating member, said first operating member being located closer to said temperature sensor than said second operating member, further comprising an insulating means directly surrounding the inner rod member and providing an abutment for said outer end portion of the inner rod member, said insulating means being defined by said outer tube being an insulating member, said inner rod member being constructed as a pressure rod provided for transferring compressive forces, said inner rod member being supported on said insulating member provided for tensile-stress under the compressive forces of said inner rod member, said insulating member having an inner end portion fixed to the base member and an outer end portion, means being provided for fixing said outer end portion of said insulating member to prevent movement in a direction towards the outer end portion.

* * * * *

UNITED STATES PATENT AND TRADEMARK OFFICE

CERTIFICATE OF CORRECTION

PATENT NO. : 4,901,049

DATED : February 13, 1990

INVENTOR(S) : Kicherer, et al

It is certified that error appears in the above-identified patent and that said Letters Patent is hereby corrected as shown below:

Col. 3, line 9, delete "DE-OS 28 38 161" and insert therefor --DE-OS 28 39 161--.

Col. 6, line 22, delete "51" and insert --4--.

Claim 29, col. 17, line 61, delete "15" and insert --28--.

Claim 29, col. 17, line 64, delete "one" and insert --over--.

Claim 1, col. 13, line 47, delete "manner" and insert --member--.

Signed and Sealed this

Twenty-first Day of May, 1991

*Attest:*

*Attesting Officer*

HARRY F. MANBECK, JR.

*Commissioner of Patents and Trademarks*